US008665051B2

(12) United States Patent
Maeda et al.

(10) Patent No.: US 8,665,051 B2
(45) Date of Patent: Mar. 4, 2014

(54) VERTICAL TRANSFORMER

(71) Applicant: TDK Corporation, Tokyo (JP)

(72) Inventors: Hiroshi Maeda, Tokyo (JP); Toru Honma, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/650,899

(22) Filed: Oct. 12, 2012

(65) Prior Publication Data

US 2013/0141204 A1 Jun. 6, 2013

(30) Foreign Application Priority Data

Oct. 12, 2011 (JP) ..... 2011-225256
Nov. 30, 2011 (JP) ..... 2011-262880

(51) Int. Cl.
*H01F 27/30* (2006.01)
*H01F 27/29* (2006.01)

(52) U.S. Cl.
USPC ..... 336/198; 336/192; 336/196; 336/199

(58) Field of Classification Search
USPC ..... 336/192, 196, 198, 199, 207, 232
See application file for complete search history.

(56) References Cited

U.S. PATENT DOCUMENTS

| | | | | |
|---|---|---|---|---|
| 8,102,237 | B2 * | 1/2012 | Espino | 336/208 |
| 2011/0115599 | A1 * | 5/2011 | Otsuki et al. | 336/221 |
| 2012/0119865 | A1 * | 5/2012 | Espino | 336/192 |
| 2013/0076473 | A1 * | 3/2013 | Chan et al. | 336/198 |

* cited by examiner

*Primary Examiner* — Alexander Talpalatski
*Assistant Examiner* — Joselito Baisa
(74) *Attorney, Agent, or Firm* — Muncy, Geissler, Olds & Lowe, P.C.

(57) ABSTRACT

A vertical transformer comprising a core provided with a middle leg installing a first and a second coils, a side leg, a first connection part connecting an end of the middle leg and that of the side leg, and a second connection part connecting the other end of the middle leg and that of the side leg, a first bobbin provided with a first hollow cylinder where at least either the first or the second coil is wound, and a core on-board face connected to an end of the first hollow cylinder, and an adhesive hardened part connecting a connection side face, and the core on-board face, and formed by hardening an adhesion, wherein the core on-board face is provided with a positioning part positioning the connection side face, and a positioning projection, is formed on both sides of the first connection part.

13 Claims, 10 Drawing Sheets

VERTICAL TRANSFORMER

BACKGROUND OF THE INVENTION

1. Field of the Invention

The present invention relates to a vertical transformer used for electrical products and the like.

2. Description of the Related Art

Transformer is used in various electrical products for various uses. For instance, when driving a backlight of liquid crystal display, an inverter resonance transformer is used to obtain a high-voltage.

Note that transformer comprises a horizontal transformer, wherein a leg of core installing coil extends approximately parallel to mounting surface of transformer, and a vertical transformer, wherein a leg of coil installing core extends approximately perpendicular (normal direction of mounting surface) to mounting surface of transformer. For instance, vertical transformer of a conventional technique described such as in Japanese non-examined patent application No. S61-81612 (Patent Article 1) had a structure where 2 walls, continuing from one end to the other end and parallel to each other at upper collar part of bobbin, are formed and connection part of magnetic material is set between the continuing 2 walls (See FIG. 7 of Patent Article 1 and the like).

SUMMARY OF THE INVENTION

Vertical transformer according to conventional technique is easy to position core with respect to bobbin by locating connection part of magnetic material between the continuing two walls, on the other hand, it had a problem that the sound (beat) of transformer occur when driving. A high-silent quality is required for an electronic component used in video/sounds equipments and the like; and that it is particularly required to suppress sound in these transformer used in such products.

Considering such circumstances, an object of the present invention is to provide vertical transformer which can suppress sounds and improve silent quality.

A coil part according to the present invention comprises a core provided with a middle leg extending approximately parallel to a first direction perpendicular to a mounting surface and installing a first and a second coils, a side leg extending approximately parallel to the first direction, a first connection part extending approximately parallel to a second direction and connecting an end portion of the middle leg and an end portion of the side leg, where the second direction is parallel to the mounting surface and connecting the middle leg and the side leg, and a second connection part extending approximately parallel to the second direction and connecting the other end portion of the middle leg and the other end portion of the side leg, which is closer to the mounting surface than the first connection part, a first bobbin provided with a first hollow cylinder where at least either the first or the second coil is wound, and a core on-board face connected to an end of the first hollow cylinder at a side closer to the first connection part and extended approximately parallel to the mounting surface, where the first connection part is on-board, and an adhesive hardened part connecting a connection side face and the core on-board face, where the connection side face is a face of the first connection part extended in order to intersect with the core on-board face, and formed by hardening an adhesion, wherein the core on-board face is provided with a positioning projection formed on both sides of the first connection part having the first connection part in between in the direction parallel to the mounting surface and intersecting the second direction, where the positioning projection is provided with a positioning part positioning the connection side face and projects from the core on-board face toward the first direction.

Inventors of the present invention have found that sounds of vertical transformer can be suppressed by changing a fixed structure of core relative to bobbin as described above. Namely, fixation methods, including adhering cores to each other, winding tape at outer periphery of transformer, and adhering core and bobbin at their opposing faces, are insufficient for fixing core to bobbin; and that it is difficult to suppress sounds by such methods. However, the adhesive hardened part connecting a connection side face, a face of the first connection part extended in order to intersect with the core on-board face, and the core on-board face is formed within vertical transformer according to the present invention. This fixed structure made by the adhesive hardened part is highly-durable to vibration which occur at transformer, and is possible to securely fix to the first bobbin, and that the transformer according to the present invention can suppress sounds.

Further, with a fixed structure of adhering opposing faces of core and bobbin, damages such as cracks occur when strength of the first bobbin (consisting materials thereof, in particular) is low. However, it is possible to suitably prevent such problems by a fixed structure of adhesive hardened part according to the present invention. Further, transformer according to the present invention comprises the positioning projection, provided with positioning part positioning the connection side face, on both sides of the first connection part having the first connection part in between. Thus, core is easily located relative to bobbin when assembly.

Further, for example, a plural number of the positioning part may be located approximately parallel to the second direction at predetermined intervals, and the adhesive hardened part may be formed between a plural number of the positioning part.

By locating a plural number of the positioning part along the second direction at predetermined intervals, and by forming the adhesive hardened part between said plural number of the positioning part, it is possible to reserve a broad connection part between the adhesive hardened part and the connection side face, and to improve adhesive strength between core and the first bobbin. Further, by locating a plural number of the positioning part along the second direction at predetermined intervals, positioning accuracy of the core can be reserved even when length of the positioning part is short.

Further, the positioning part may be located on both ends of the core on-board face along the second direction.

By locating the positioning part on both ends of the core on-board face along the second direction, positioning accuracy of core can be reserved. Further, with this position, it is possible to lengthen the adhesive hardened part formed between the positioning parts along the second direction, which leads to an improvement of adhesive strength.

Further, for instance, a wall section, extending approximately parallel to the second direction and is located by having the adhesive hardened part between the first connection part and said wall section, may be formed.

This wall section improves strength of the first bobbin as well as prevents adhesion to flow out to unintended places when assembling. Accordingly, transformer according to the present invention having such wall section is superior in mechanical endurance, which makes its assembly easy.

In addition, for example, vertical transformer according to the present invention further comprises a second bobbin provided with a second hollow cylinder which either the first or the second coil is wound, and a terminal mounting part connected to an end of the second hollow cylinder at a side close to the mounting surface, where a terminal is electrically connected to the first and the second coils, wherein the other the first or the second coil is wound to the first bobbin.

The present invention is suitably applied to a vertical transformer of a 2 piece structured bobbin. As mentioned above, fixed structure according to the present invention show good durability even with low strength of the first bobbin; this provides greater range of choices of materials configuring the first bobbin. Accordingly, transformer according to the present invention prevent sound and adapt easily-assembled structure, such as a set-in structure using elastic deformation of the first bobbin.

In addition, within vertical transformer according to the present invention, either the first or the second coil may be located at inner circumference side of the other the first or the second coil.

Transformer adapting a doubly-structure, wherein one coil is located at inner circumference side of the other coil, is advantageous for a low height profile, while bobbin structure tends to be complicated when compared to a transformer of a single-structure. As mentioned above, fixed structure according to the present invention shows good durability even with low strength of the first bobbin; this expands the design possibility of material and formation of bobbin within transformer according to the present invention. Therefore, transformer according to the present invention comprising a doubly-structure is possible to reserve superior durability and silence. Further, it is possible to simplify the manufacturing method by adapting set-in structure and the like Vertical transformer according to the second aspect of the present invention comprises a core provided with a middle leg extending approximately parallel to a first direction perpendicular to a mounting surface and installing a first and a second coils, a side leg extending approximately parallel to the first direction, a first connection part extending approximately parallel to a second direction, a direction parallel to the mounting surface connecting the middle leg and the side leg, and connecting an end portion of the middle leg and an end portion of the side leg, and a second connection part extending approximately parallel to the second direction and connecting the other end portion of the middle leg and the other end portion of the side leg, a first bobbin provided with a first hollow cylinder where at least either the first or the second coil is wound, a first core on-board face connected to an end of the first hollow cylinder at a side closer to the first connection part, extended approximately parallel to the mounting surface, and opposed to the first connection part, and a first inclined surface formed on both sides of the first connection part having the first connection part in between in the direction parallel to the mounting surface and intersecting the second direction, rising from the first core on-board face to the first direction, and a first adhesive hardened part, connecting a first connection side face and the first inclined surface of the first bobbin, where the first connection side face is a face of the first connection part extended in order to intersect with the first core on-board face, and formed by hardening an adhesion.

The first bobbin of vertical transformer according to the second aspect of the present invention comprises the first inclined surface, rising upward from the first core on-board surface toward the first direction, and the first adhesive hardened part, connecting the first connection part side face of core and the first inclined surface of the first bobbin. Such fixed structure of the first adhesive hardened part is highly-durable to vibration which occur at the transformer, and is possible to securely fix core to the first bobbin; and that transformer according to the present invention can suppress sounds.

Further, with a fixed structure of adhering opposing faces of core and bobbin, damages such as cracks may occur or adhesion may be removed when strength of the first bobbin (consisting materials thereof, in particular) is low. However, it is possible to suitably prevent such problems by a fixed structure of adhesive hardened part according to the present invention. Further, within a vertical transformer according to the present invention, a distance between the first inclined surface and the first connection part side face is relatively narrow at a part close to the first core on-board face, while relatively wide at a part distant from the first core on-board face. With vertical transformer provided with such structure, adhesion can be easily injected from a wide space between the first inclined surface and the first connection part side face; and the injected adhesion is preferably induced toward adhesion faces of the first inclined surface and the first connection part side face. Therefore, manufacturing method of vertical transformer according to the present invention is easy, and the first adhesive hardened part is possible to securely connect the first inclined surface and the first connection part side face. In vertical transformer according to the present invention, an amount of adhesion required for adhering can be reduced when compared to the same without the first inclined surface. Accordingly, used amount of adhesion can be suppressed while realizing high adhesion strength.

Further, for instance, the first bobbin may comprise a positioning surface located on both sides of the first connection part having the first connection part in between in the direction parallel to the mounting surface and intersecting the second direction, rising approximately upright from the first core on-board face.

With positioning surface rising upright from the first core on-board face, in addition to the first inclined surface rising upward from the first core on-board face, core is easily positioned relative to the first bobbin within such vertical transformer and that it can be easily and accurately assembled.

Further, for instance, the positioning surface may be located on both ends of the first core on-board face along the second direction having the first inclined surface in between.

It is possible to improve positioning accuracy of core by locating positioning surface on both ends of core on-board face along the second direction. Further, with this arrangement, it is possible to lengthen the first adhesive hardened part formed between the positioning parts along the second direction, which makes it possible to improve adhesion strength.

Further, for instance, the first inclined surface may be inclined at 15 to 60 degrees to the first core on-board face.

Although inclination angle of the first inclined surface is not particularly limited, both an effect to induce adhesion to adhering face and an effect to suppress used amount of adhesion can suitable achieved.

Further, for instance, vertical transformer according to the present invention may further comprise the second bobbin provided with a second hollow cylinder where either the first or the second coil is wound, and a second core on-board face connected to an end of the second hollow cylinder at a side closer to the second connection part, extended approximately parallel to the mounting surface, and opposed to the second connection part, wherein the other the first or the second coil may be wound to the first bobbin.

The second aspect of the present invention is suitably applied to a vertical transformer wherein bobbin has a 2 piece structure. As mentioned above, fixed structure according to the present invention show good durability even with low strength of the first bobbin; this provides greater range of choices of materials configuring the first bobbin. Accordingly, transformer according to the present invention prevents sound with adapting easily-assembled structure, such as a set-in structure using elastic deformation of the first bobbin.

Further, for instance the second bobbin may be provided with a second inclined surface formed on both sides of the second connection part having the second connection part in between in the direction parallel to the mounting surface and intersecting the second direction, rising from the second core on-board face to a opposing direction of the first direction, and a second adhesive hardened part may be formed between a second connection side face and the second inclined surface of the second bobbin, which connect the second connection part side face and the second inclined surface and is formed by hardening an adhesion, where the second connection side face is a face of the second connection part extended in order to intersect with the second core on-board face.

With vertical transformer of a 2 piece structured bobbin, adhesion structure, adapted between the first bobbin and core, may be adapted between the second bobbin and core. Vertical transformer adapting such adhesion structure is able to provide stronger fixation of core relative to bobbin, and sound preventing effect may be further expected.

Further, within vertical transformer according to the second aspect of the invention, the first or the second coil is located at inner circumference side of the other the first or the second coil.

Transformer adapting a doubly-structure, wherein one coil is located at inner circumference side of the other coil, is advantageous for low height profile, while bobbin structure tends to be complicated when compared to a transformer of single-structure. As mentioned above, fixed structure according to the present invention shows good durability even with low strength of the first bobbin; this expands the design possibility of material and formation of bobbin within transformer according to the present invention. Therefore, transformer according to the present invention comprising a doubly-structure is possible to reserve superior durability and silence. Further, it is possible to simplify the manufacturing method by adapting set-in structure and the like.

DETAILED DESCRIPTION OF THE INVENTION

Hereinafter, the invention will be described according to embodiments shown by figures.

Figure 1:
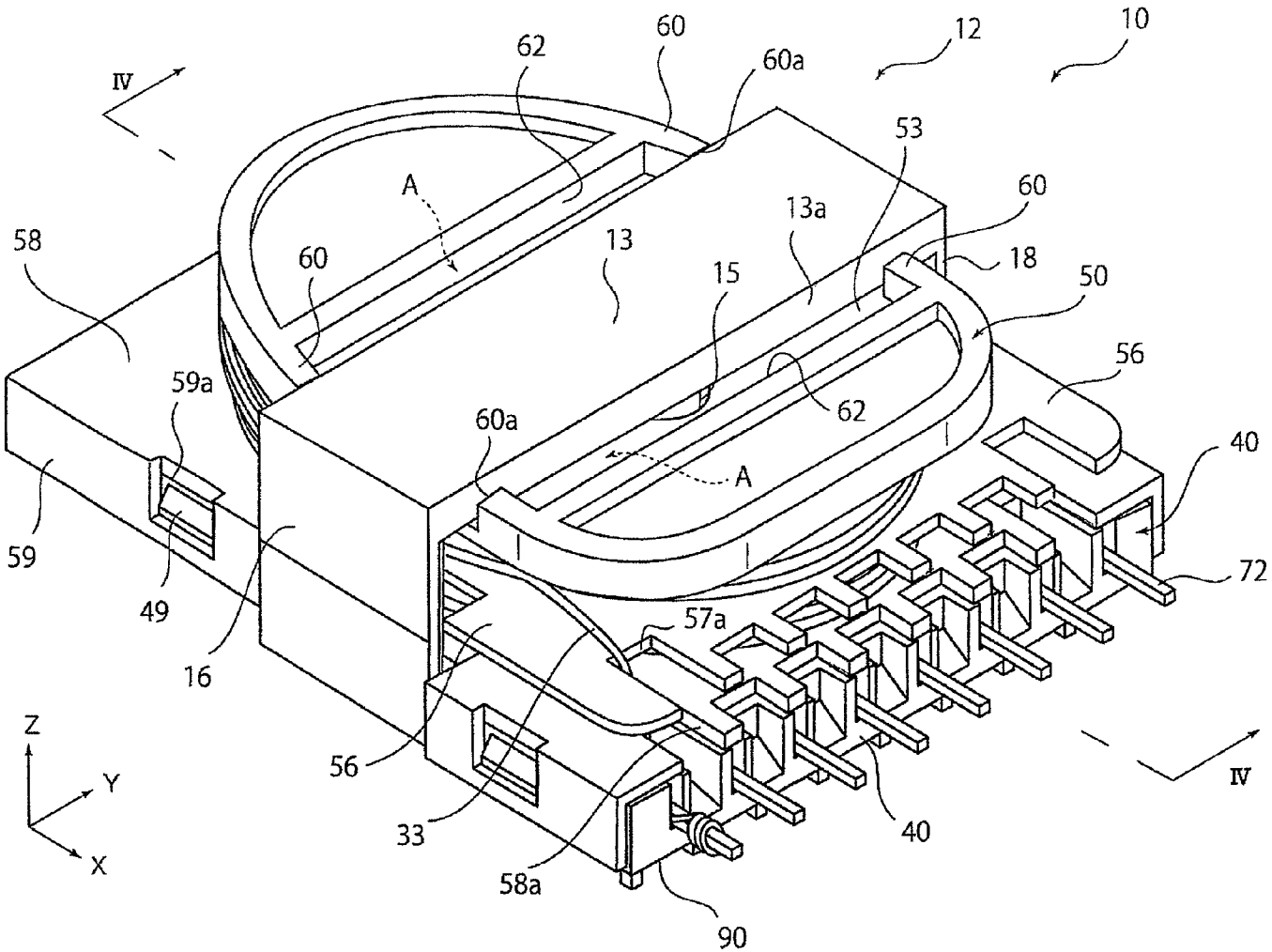
FIG. 1 is an overall perspective view of a transformer according to an embodiment of the present invention.

Shown in FIG. 1, transformer 10 according to an embodiment of the present invention comprises core 12, the first bobbin 50, and the second bobbin 40.

Core 12 of transformer 10 is configured with soft magnetic materials, such as ferrite and the like, and forms a flux path where flux generated from later described the first and the second coil 30, 20 passes. Core 12 comprises middle leg 15, side legs 16, 18, the first connection part 13 and the second connection part 14 (See FIG. 2). Middle leg 15 of core 12 is extended approximately parallel to the first direction (z-axis direction in figures), which is perpendicular to mounting surface 90 of transformer 10, installing the first coil 30 and the second coil 20. Side legs 16, 18 are extended approximately parallel to Z-axis, as is the same with middle leg 15, and have approximately the same length with middle leg 15. Side legs 16, 18 are disposed, sandwiching middle leg 15 from both sides in Y-axis direction.

Figure 2:
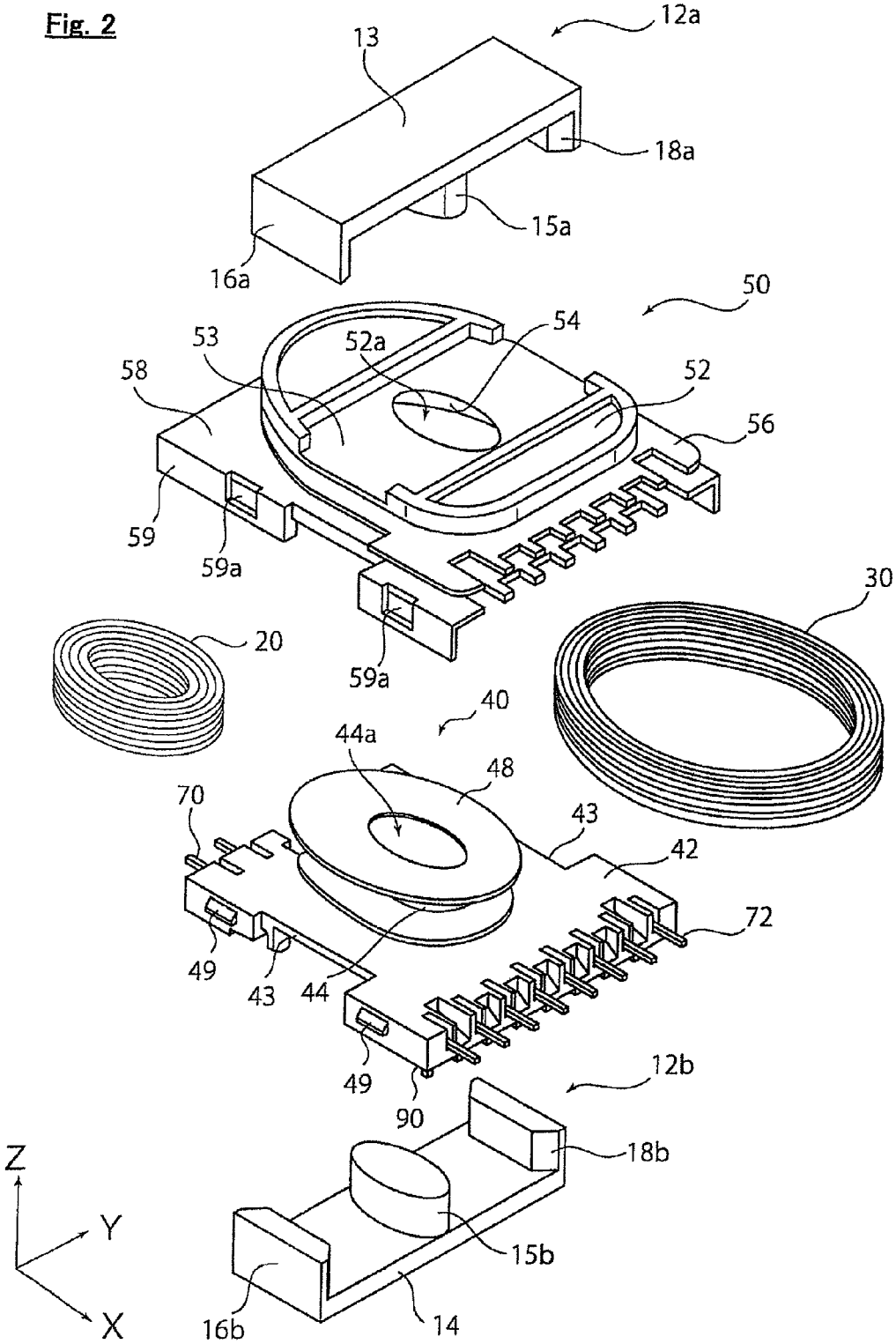
FIG. 2 is an exploded perspective view of the transformer shown in FIG. 1.

As shown in FIGS. 1 and 2, the first connection part 13 of core 12 is extended approximately parallel to the second direction (Y-axis direction in figures), a direction parallel to mounting surface 90 and a direction connecting middle leg 15 and side legs 16, 18. The first connection part 13 of core 12 connects one end portion of middle leg 15 and one end portions of side legs 16, 18. In contrast, the second connection part 14 of core 12, as shown in FIG. 2 and as is the same with the first connection part 13, is extended approximately parallel to Y-direction, connecting the other end portion of middle leg 15 and the other ends of side legs 16, 18. Out of connection parts 13, 14, which connect middle leg 15 and side legs 16, 18, a side distant from mounting surface 90 (See FIG. 1) of transformer 10 is the first connection part 13 and a side closer to mounting surface 90 than the first connection part 13 is the second connection part 14. Note that mounting surface 90 of transformer 10 is, when mounting transformer 10 to a substrate, a bottom surface of transformer 10 opposing the substrate. As is shown in FIG. 1, mounting surface 90 is parallel to X-Y plane.

Core 12, as shown in FIG. 2, is formed by assembling separately-formed the first core 12*a* and the second core 12*b*. The first core 12*a* and the second core 12*b* have symmetrical shape and they are attached to each other, sandwiching the first bobbin 50 and the second bobbin 40 from upward and downward directions (Z-axis direction in figures). Longitudinal planes (cut planes including Y and Z axes in FIG. 1) of the first core 12*a* and the second core 12*b* respectively show approximately E-shape.

Note that, in figures, Z-axis (the first direction) is a height direction of transformer 10, and it enables low height profile of a transformer as the height of Z-axis direction in transformer 10 becomes lower. Furthermore, X-axis and Y-axis are perpendicular to each other and also are perpendicular to Z-axis. In this embodiment, Y-axis corresponds to an array direction of the first terminals 72 and connecting direction (the second direction) with side legs 16, 18 and X-axis corresponds to a longitudinal direction of transformer 10.

As shown in FIG. 2, the second bobbin 40 comprises an approximately rectangular planar bobbin substrate 42. Bobbin substrate 42 is connected to an end portion (an end portion of the second hollow cylinder 44 at its lower part) of the second hollow cylinder 44 at mounting surface 90 side. A bottom surface side of bobbin substrate 42 is mounting surface 90 of transformer 10. On one end of bobbin substrate 42 along X-axis direction, a plural number (4 in an example shown by the figure) of the second terminals 70 are fixed at predetermined intervals along Y-axis direction. Further, on the other end of bobbin substrate 42 along X-axis direction, a plural number (8 in an example shown by the figure) of the first terminals 72 are fixed at predetermined intervals along Y-axis direction.

These terminals 70 and 72 are composed of such as metal terminal, and they are integrally formed by an insert molding procedure and the like with the bobbin substrate 42, which is composed of insulation materials such as synthetic resins. As later described, a lead part of the second coil 20 is connected to the second terminal 70, and a lead part of the first coil 30 is connected to the first terminal 72. Thus, bobbin substrate 42 is a terminal mounting part, where terminals 70, 72 electrically connecting coils 20, 30 are mounted.

The second hollow cylinder 44 is formed projecting along Z-axis direction, in approximately middle position of bobbin substrate 42. The bobbin collar part 48 is connected to upper end part of the second hollow cylinder 44. Bobbin collar part 48 project from the second hollow cylinder 44 in a radical direction approximately parallel to X-Y axis plane, and hold the second coil 20. It is preferable that the bobbin substrate 42, the second hollow cylinder 44 and the bobbin collar 48 are integrally formed by an injection molding and the like.

Through hole 44*a* is formed to bobbin substrate 42, the second hollow cylinder 44 and bobbin collar part 48, passing through thereof along Z-axis direction. A shape of the through hole 44*a* corresponds to that of a through hole 52*a*, formed on the latter described first bobbin 50. And as shown in FIG. 2, the shape of the through hole 44*a* has an elliptical shape that enables a middle leg 15 (15*a*, 15*b*) of core 12 (the first core 12*a*, the second core 12*b*) to insert.

Figure 4:
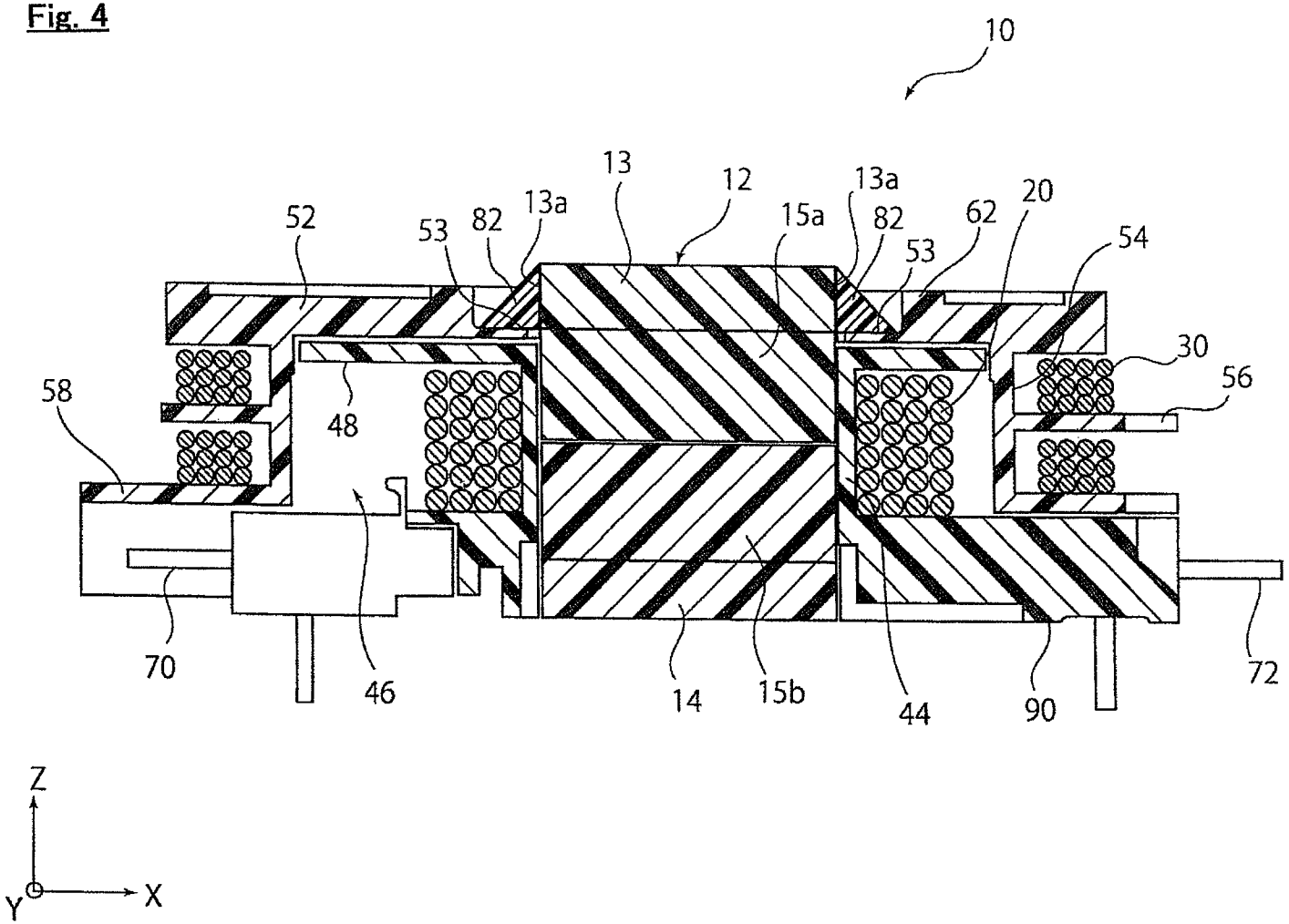
FIG. 4 is a cross-sectional view of transformer perpendicular to a mounting surface.

As shown in FIG. 4, the second coil 20 is wound at the outer circumference of the second hollow cylinder 44. The second hollow cylinder 44 function as a bobbin body of the second coil 20.

FIG. 2 shows a perspective view of the second coil 20. The second coil 20, as shown in FIGS. 2 and 4, is formed along an outer shape of the second hollow cylinder 44, and has an elliptical shape, as is the same with an outer shape of the second hollow cylinder 44. The second coil 20, as shown in FIGS. 2 and 4, is formed to fit inside the latter described first hollow cylinder 54 of the first bobbin 50, and to locate at inner circumference side of the first coil 30, which is wound around the outer circumference of the first hollow cylinder 54.

As shown in FIG. 2, concave parts 43 are formed, allowing passages of side legs 16*b*, 18*b* of the second core 12*b*, on both sides of bobbin substrate 42 in Y-axis direction. Concave part 43 is placed to have the same position with the second hollow cylinder 44 in X-axis direction. Further, engaging projections 49 are formed on both sides of bobbin substrate 42 in Y-axis direction at both sides of concave part 43, which are removable engagements with engaging holes 59*a* of the first bobbin 50.

As shown in FIGS. 2 and 4, the first bobbin 50 determines a part of an outer shape of transformer 10, along with holding the first coil 30 (see FIG. 4 and so on). As shown in FIGS. 1 and 4, the first bobbin 50 comprises the first hollow cylinder 54 to which the first coil 30 is wound. The first hollow cylinder 54 function as a bobbin body of the first coil 30.

On the upper end portion of the first hollow cylinder 54, an upper collar part 52, projecting in a radical direction along X-Y plane, is formed. As shown in FIG. 2, a through hole 52*a* is formed to the upper collar part 52, which installs middle leg 15*a* of the first core 12*a*.

Core on-board surface 53, extending approximately parallel to mounting surface 90, is formed on the upper surface of upper collar part 52. Core on-board surface 53 is connected to an end portion (an upper end portion) of the first hollow cylinder 54 closer to the first connection part 13. On said core on-board surface 53, as shown in FIGS. 1 and 4, the first connection part 13 of core 12 is on-board.

Figure 3:
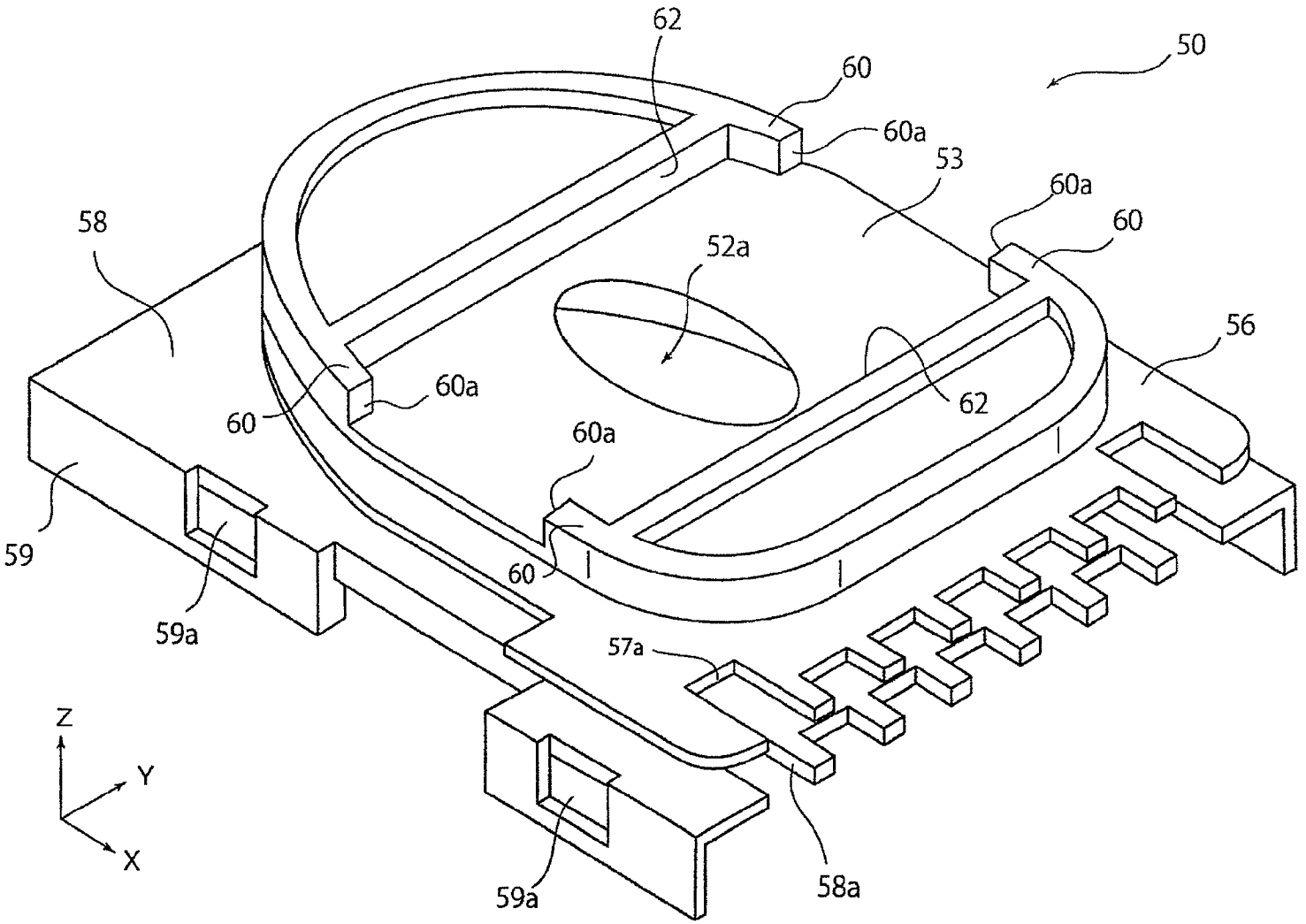
FIG. 3 is a perspective view of the first bobbin included in the transformer shown in FIG. 1.

As shown in FIG. 3, positioning projection 60, which locates the first connection part 13 of core 12, is formed on core on-board surface 53 of the first bobbin 50. Positioning projection 60 project from core on-board surface 53 in Z-axis direction (the first direction). As shown in FIG. 1, positioning projection 60 is formed on both sides of the first connection part 13, sandwiching said first connection part 13 a direction parallel to mounting surface 90 and X-axis direction intersecting Y-axis direction.

As shown in FIG. 3, positioning projection 60 contact with the first connection part 13 or comprise positioning part 60*a*, which is closest to the first connection part 13 of positioning projection 60. As shown in FIG. 1, positioning part 60*a* correspond to connection side face 13*a*, which is a side face of the first connection part 13, and locate connection side face 13*a* in X-axis direction (a direction perpendicular to Y-axis direction). Connection side face 13*a* is a face which extends in a direction intersecting core on-board surface 53 of the first connection part 13. An example shown in FIG. 1, connection side face 13*a* extends approximately perpendicular to core on-board surface 53.

It is preferable that a plural number of positioning part 60*a* is located approximately parallel to Y-axis direction (the second direction) at predetermined intervals. In the present embodiment, it is placed in 2 places at both ends of core on-board surface 53 in Y-axis direction; namely 4 places in total.

Besides positioning projection 60, wall section 62 extending approximately parallel to Y-axis direction (the second direction) is formed on core on-board surface 53. It is abbreviated in FIG. 1 that transformer 10 comprises adhesive hardened part 82 (See FIG. 4), which fixes the first connection part 13 of core 12 to the first bobbin 50. Wall section 62 is formed by having adhesive hardened part 82 between the first connection part 13 and said wall section 62 in X-axis direction. Further, adhesive hardened part 82 is formed between two positioning parts 60*a*, disposed approximately parallel in Y-axis direction; and is preferably formed by extending along Y-axis direction, which is a longitudinal direction of the first connection part 13. Further, as shown by the dotted line of arrow A in FIG. 1, adhesive hardened part 82 is formed by an area surrounded by positioning projection 60, wall section 62 and connection side face 13*a*.

Adhesive hardened part 82 is an adhesive hardened part where the first connection part 13 of core 12 and core on-board surface 53 of the first bobbin 50 are adhered. As shown in FIG. 4 of a cross-sectional view, adhesive hardened part 82 connects connection side face 13*a* and core on-board surface 53. FIG. 4 shows a cross-sectional view which goes through middle leg 15 (15*a*, 15*b*). Adhesive hardened part 82 connects connection side face 13*a* and core on-board surface 53, and this can also be seen from a cross-section between middle leg 15 and side legs 16, 18.

Not shown in FIG. 1, but shown in FIG. 4 that the first hollow cylinder 54 of the first bobbin 50 projects in perpendicular direction from under surface of upper collar part 52 in Z-axis direction aiming downward. The first hollow cylinder 54 has a formation shown in FIG. 2, where outer circumference of bobbin collar part 48 is covered. As shown in FIG. 4, the second coil 20 and middle leg 15 (15*a*, 15*b*) are stored in the first hollow cylinder 54. Namely, middle leg 15 and the second coil 20 are installed inside the first hollow cylinder 54.

As shown in FIGS. 1 and 3, rectangular formed lower collar part 58 is formed at lower end portion of the first hollow cylinder 54, approximately parallel to X-Y plane. Lower collar part 58 is attached in order to cover upper surface of bobbin substrate 42 of the second bobbin 40.

Side surface parts 59 extracting downwardly are formed on the end portions of both sides of lower collar part 58 in Y-axis direction. Engaging hole 59*a*, engaging with engaging projections 49 of the second bobbin 40, is formed on side surface part 59. The first bobbin 50 and the second bobbin 40 are assembled by engaging engaging projections 49 to engaging hole 59*a* by using elastic deformation of side surface part 59.

As shown in FIGS. 1 and 4, one or more middle collar part 56 which divisionally dispose the first coil 30 in Z-axis direction is set on the outer periphery face of the first hollow cylinder 54, which is located between upper collar part 52 and lower collar part 58, depending on the intended use and etc. of transformer 10. These collar parts 52, 56, 58 are parallel to X-Y plane. The first bobbin 50, comprising these collar parts 52, 56, 58 and the first hollow cylinder 54, is integrally molded by injection molding and the like. As shown in FIG. 4, transformer 10 comprises a doubly-structure wherein the second coil 20 and the first coil 30 are wound around middle leg 15 of core 12 twice.

As shown in FIG. 4, the first coil 30 of the present embodiment is configured with two independent coils; however, the first coil 30 can be configured with one coil or 3 or more coils. The first coil 30 contacts the first hollow cylinder 54; and winding shape of the first coil 30 and outer periphery shape of the first hollow cylinder 54 are oval shapes.

As shown in FIG. 1, tip end portion of middle collar part 56 in X-axis direction extends to the end portion of bobbin substrate 42, where the first terminal 72 is formed, and forms groove part for lead 57*a* which guides lead 33 of the first coil 30 to the first terminal 72. Further, lower collar part 58 of the first bobbin 50, as is the same with middle collar part 56, extends to the end portion of bobbin substrate 42 in X-axis direction and forms groove part for lead 58*a* which guides lead 33 to the first terminal 72.

Transformer 10 of the present embodiment is formed by assembling each part shown in FIG. 2 and by winding wire around the second bobbin 40 and the first bobbin 50. Hereinafter, an example of manufacturing method of transformer 10 will be described by the use of FIG. 2 and the like. When manufacturing transformer 10, the second bobbin 40, where the second terminal 70 and the first terminal 72 are set, is prepared at first. Although material of the second bobbin 40 is not particularly limited, it is formed by insulating materials such as resin, phenol resin and the like is particularly preferable in terms of heat resistance and the like.

Next, wire is wound around the second hollow cylinder 44 of the second bobbin 40, and the second coil 20 (see FIG. 4) is formed. Although wires used to form the second coil 20 are not particularly limited, litz wire and the like are preferably used. The end portion of wire, when forming the second coil 20, is tangled and connected to the second terminals 70 via communication passage 46 (See FIG. 4) of the second bobbin 40.

Next, the first bobbin 50 shown in FIG. 2 is set to the second bobbin 40 where the second coil 20 is mounted. The first bobbin 50 and the second bobbin 40 are assembled by engaging the engaging hole 59*a* of the first bobbin 50 to engaging projection 49 of the second bobbin 40. Further, the first bobbin 50 and the second bobbin 40 are fixed by adhesion and the like, when necessary. Although material of the first bobbin 50 is not particularly limited, it can be formed by insulating materials such as resin; and it is preferably formed by PET (polyethylene terephthalate) and the like, in terms of easiness for elastic deformation.

Next, wire is wound around the first hollow cylinder 54 of the first bobbin 50 and forms the first coil 30 (See FIG. 4). Although wire used for the formation of the first coil 30 is not particularly limited, litz wire and the like is suitably used. Lead 33, which is a tip end portion of wire when forming the first coil 30, is wound around the first terminals 72 by engaging with groove part for lead 57*a*, 58*a*.

Next, the first core 12*a* and the second core 12*b* are mounted to an intermediate assembly, wherein the second coil 20, the first coil 30, the first bobbin 50 and the second bobbin 40 are assembled, from vertical directions of Z-axis to form core 12. Namely, each tip end of middle legs 15*a*, 15*b* of the first core 12*a* and the second core 12*b*, each tip end of side legs 16*a*, 16*b* and each tip end of side legs 18*a*, 18*b* are bond together. Further, there may be a gap between tip ends of middle legs 15*a* and 15*b*. The first core 12*a* and the second core 12*b* of core 12 are adhered by using adhesion. Although soft magnetic materials such as metal, ferrite and the like are exemplified for material of core 12, it is not particularly limited.

Next, adhesion is coated between connection side face 13*a* and core on-board surface 53: a place shown by arrow A in FIG. 1, and adhesive hardened part 82 shown in FIG. 4 is formed, fixing core 12 to the first bobbin 50. Although adhesion forming adhesive hardened part 82 is not limited, it is preferable to use a relatively high-viscosity adhesion, such as a silicon series adhesion, in terms of linking connection side face 13*a* and the core on-board surface 53, which extend in directions intersecting one another. Further, a gap between connection side face 13*a* and wall section 62 are designed to have a width, which a nozzle discharging adhesion can suitably approach the coated face.

Lastly, a tape can is wound around the outer periphery, and varnish impregnated treatment can be provided. With the progresses above, transformer 10 of the present embodiment can be manufactured.

Transformer 10 is a vertical transformer wherein middle leg 15 extends approximately parallel to Z-axis direction (normal direction of mounting surface 90), a direction perpendicular to mounting surface 90. Vertical transformer 10, shown in FIGS. 1 and 4, comprises connection parts 13, 14 of core 12 on upward and downward of the first and the second coils 30, 20 in Z-axis direction. These connection parts 13, 14 prevent flux leakage in upward and downward directions. Therefore, when compared to a horizontal transformer which vertical direction of coil is rarely shielded by core, flux leakage of transformer 10 in vertical direction can be prevented.

Further, as shown in FIG. 4, transformer 10 is a doubly-structure wherein the first coil 30 goes around outer periphery of the second coil 20. With this doubly-structure, length of core 12 in axis direction can be shortened; and vertical and thin coil can be realized.

Therefore, transformer 10 can suppress the occurrence of eddy current in surrounding parts and the like, without placing aluminum shield. Further, by suppressing the occurrence of eddy current, transformer 10 can decrease the occurrence of heat and noise associated with the occurrence of eddy current. Further, transformer 10 is not necessary to place shield board to shield flux leakage and that a preferable heat dissipation characteristic can be obtained. Furthermore, due to short length of middle leg 15 and side legs 16, 18 of core 12, damage of core 12 by external impact and the like is prevented.

Here, vertical transformer according to conventional technique had a problem that a sound occurs when driving. Transformer 10 according to the present embodiment suppressed the sound when driving by improving the fixed structure of core 12 and the first bobbin 50. Namely, as shown in FIG. 4, transformer 10 comprises adhesive hardened part 82 connecting the connection side face 13*a*, a face of the first connection part 13 which extend in a direction intersecting core on-board surface 53, and the core on-board surface 53. Adhesive hardened part 82 shown in FIG. 4 is highly-durable against vibration which occur in transformer 10. Therefore, it is possible to firmly fix core 12 to the first bobbin 50, preventing sounds of transformer 10.

Damages such as crack and the like are hard to occur in the first bobbin 50 with the fixed structure of adhesive hardened part 82 of transformer 10, when compared to a fixed structure adhering opposing faces of core 12 and the first bobbin 50; and that it is preferably used within the first bobbin 50 with relatively low strength. Further, as shown in FIG. 1, positioning projection 60 which determines a position of connection side face 13*a* is formed to core on-board surface 53; transformer 10 therefore is possible to easily position the first core 12*a* with respect to the first bobbin 50 when assembling. Note that a length of positioning part 60*a* in Y-axis direction is shorter than a length of core on-board surface 53 in Y-axis direction, in order to reserve a region for forming adhesive hardened part 82 which connect connection side face 13*a* and core on-board surface 53. Further, when a plural number of positioning parts 60*a* are located along Y-axis direction, a total length of positioning parts 60*a* located along Y-axis direction is shorter than a total length of core on-board surface 53 along Y-axis direction.

As shown in FIG. 1, by locating a plural number of positioning parts 60*a* with determined intervals and setting adhesive hardened parts 82 in between, it is possible to reserve a broad connection part of adhesive hardened part 82 and connection side face 13*a* and to improve adhesion strength of core 12 and the first bobbin 50. Further, by locating a plural number of positioning parts 60*a* along Y-axis direction at predetermined intervals, positioning accuracy can be reserved even when a length of positioning part 60*a* in Y-axis direction is short. Particularly, locating positioning part 60*a* at both ends of core on-board surface 53 in Y-axis direction is effective in terms of both adhesion strength and positioning accuracy.

Further, wall section 62 formed to core on-board surface 53 is possible to improve strength of upper collar part 52, where core on-board surface 53 is formed, and is possible to prevent adhesion forming adhesive hardened part 82 to flow out to unintended places when assembling. As shown in FIG. 3, forming wall section 62 connecting positioning parts 60*a*, which are formed on both ends of core on-board surface 53, is particularly preferable in terms of improving strength of the first bobbin 50 and preventing flow out of adhesion.

Further, the first bobbin 50, comprising adhesive hardened part 82, positioning projection 60, positioning part 60*a*, wall section 62 and the like, is particularly preferable for upper bobbin of transformer 10, which comprises a plural number of bobbins. The reason for this is that, due to an excellent fixed structure of the first bobbin 50 and core 12 in transformer 10, it is possible to use materials of relatively low strength, such as PET, as the first bobbin 50 and to adopt structure simplifying the assembly, such as a set-in structure using elastic deformation of side surface part 59. Note that, unlike the second bobbin 40 where terminals 70, 72 are formed, heat resistance required for solder treatment and the like is not required for the first bobbin 50; and that, in this respect, there are many choices for its material.

Second Embodiment

Transformer 10*d* according to the second embodiment of the present invention will be described referring to FIGS. 5 to 10. Note that transformer 10*d* according to the second embodiment is the same with transformer 10 according to the first embodiment, except for formation of the first bobbin 50 and the like. Common codes are added to common parts, and the explanation for that is abbreviated.

Figure 5:
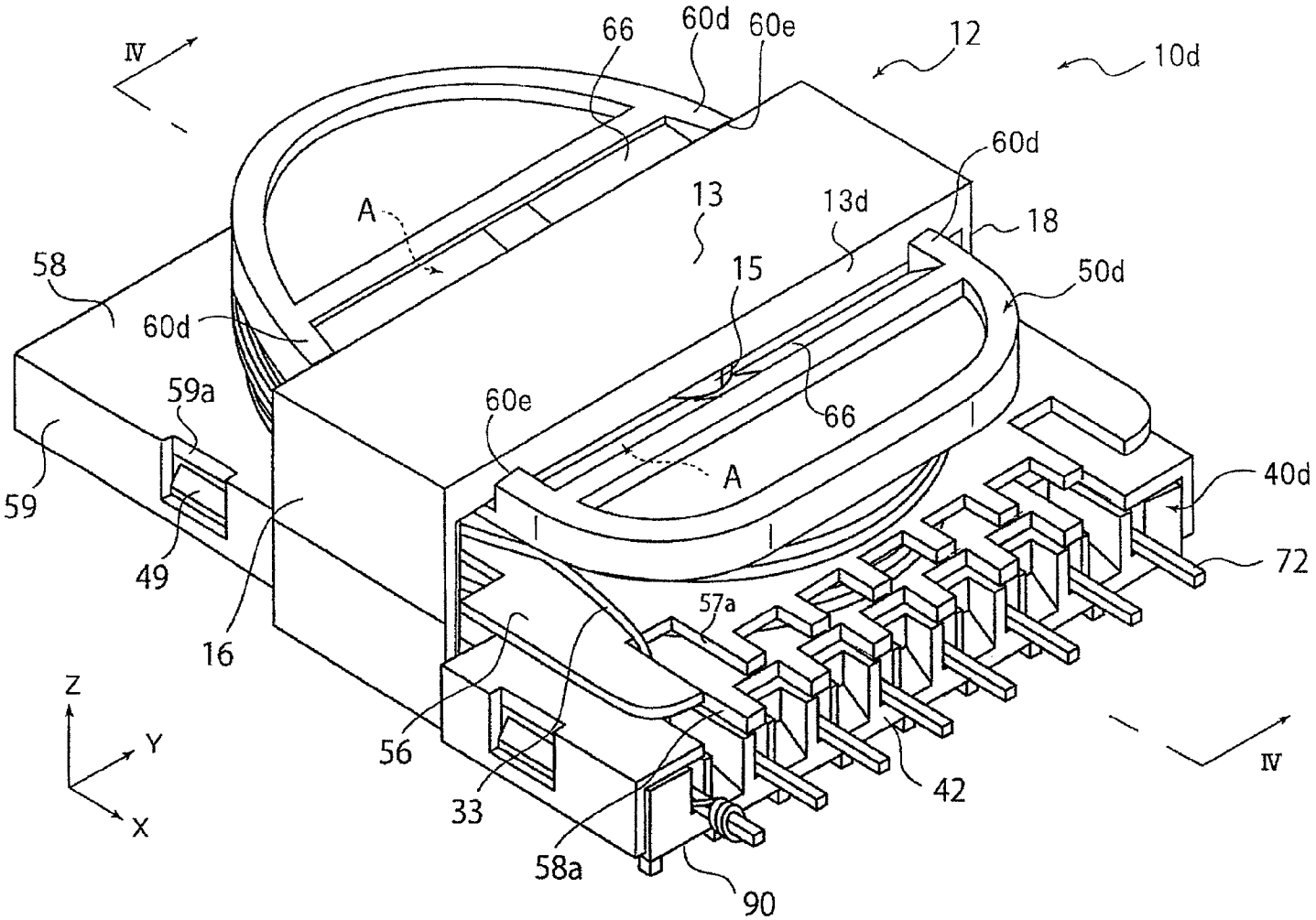
FIG. 5 is an overall perspective view of a transformer according to the second embodiment of the present invention.
Figure 6:
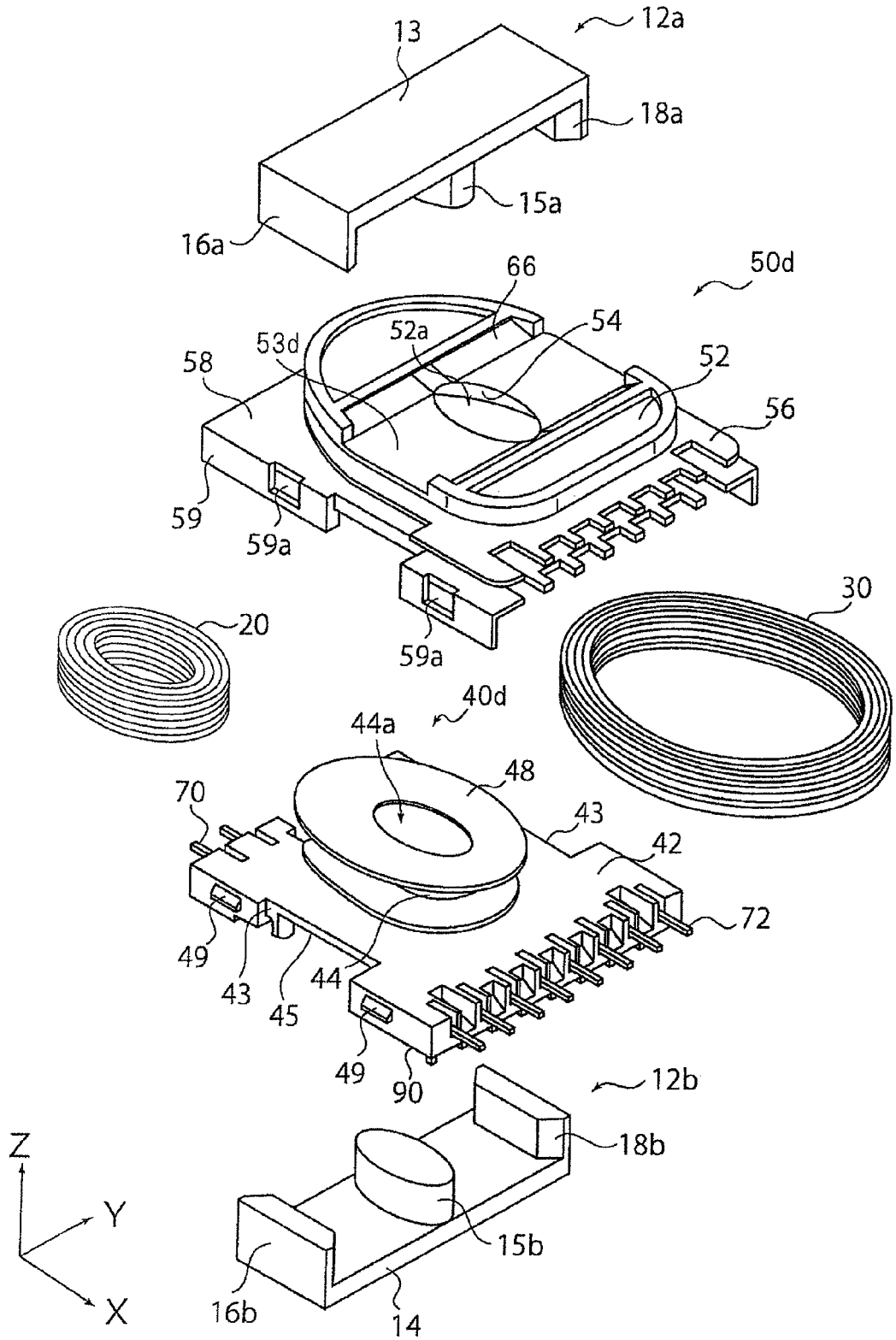
FIG. 6 is an exploded perspective view of transformer shown in FIG. 5.

As shown in FIGS. 5 and 6, the first connection part 13 of core 12 extends approximately parallel to a direction parallel to mounting surface 90 and to the second direction connecting middle leg 15 and side legs 16, 18. And the first connection part 13 connects one end portion of middle leg 15 and one end portions of side legs 16, 18. On the other hand, the second connection part 14 of core 12 extends approximately parallel to Y-axis direction and connects the other end portion of middle leg 15 and the other end portions of side legs 16, 18, as is the same with the first connection part 13 and as shown in FIG. 6. In the present embodiment, out of connection parts 13, 14 connecting middle leg 15 and side legs 16, 18, a side separate from mounting surface 90 (See FIG. 5) of transformer 10*d* is determined the first connection part 13 and a side closer to the mounting surface 90 than the first connection part 13 is determined the second connection part 14. Note that, on the contrary, an embodiment determining a side separate from mounting surface 90 of transformer 10*d* as the second connection part and a side closer to mounting surface 90 than the second connection part as the first connection part is included in the present embodiment.

As shown in FIG. 6, the second bobbin 40*d* comprises an approximately rectangular planar bobbin substrate 42. At a part of downward surface of bobbin substrate 42, the second core on-board face 45 extending approximately parallel to mounting surface 90 is formed. The second core on-board face 45 is connected to end portion of the second hollow cylinder 44 close to the second connection part 14 (lower end portion of the second hollow cylinder 44) and located opposing to the second connection part 14 of core 12.

At the other part of downward surface of bobbin substrate 42, mounting surface 90 of transformer 10*d* is formed. Mounting surface 90 is located lower side (negative direction side of Z-axis) than the second core on-board face 45. On one end of bobbin substrate 42 along X-axis direction, a plural number (4 in an example shown by the figure) of the second terminals 70 are fixed at predetermined intervals along Y-axis direction. Further, on the other end of bobbin substrate 42 along X-axis direction, a plural number (8 in an example shown by the figure) of the first terminals 72 are fixed at predetermined intervals along Y-axis direction.

The second hollow cylinder 44 (See FIG. 8) is formed projecting along Z-axis direction, in approximately middle position of bobbin substrate 42. The bobbin collar part 48 is connected to upper end part of the second hollow cylinder 44. Bobbin collar part 48 project from the second hollow cylinder 44 in a radical direction approximately parallel to X-Y axis plane, and hold the second coil 20. It is preferable that the bobbin substrate 42, the second hollow cylinder 44 and the bobbin collar 48 are integrally formed by an injection molding and the like.

Through hole 44*a* is formed to bobbin substrate 42, the second hollow cylinder 44 and bobbin collar part 48, passing through thereof in Z-axis direction. A shape of the through hole 44*a* corresponds to that of a through hole 52*a*, formed on the latter described first bobbin 50*d*. And as shown in FIG. 6, the shape of the through hole 44*a* has an elliptical shape that enables a middle leg 15 (15*a*, 15*b*) of core 12 (the first core 12*a*, the second core 12*b*) to insert. Note that, not shown in FIG. 6, opening of through hole 44*a* at negative direction side of Z-axis is formed to the second core on-board face 45 of bobbin substrate 42.

As shown in FIG. 6, concave parts 43 are formed, allowing passages of side legs 16*b*, 18*b* of the second core 12*b*, on both sides of bobbin substrate 42 in Y-axis direction. Concave part 43 is formed on both ends of the second core on-board face 45 in Y-axis direction and is placed to have the same position with the second hollow cylinder 44 in X-axis direction. Further, engaging projections 49 are formed on both sides of bobbin substrate 42 in Y-axis direction at both sides of concave part 43 in X-axis direction, which are removable engagements with engaging holes 59*a* of the first bobbin 50*d*.

Figure 8:
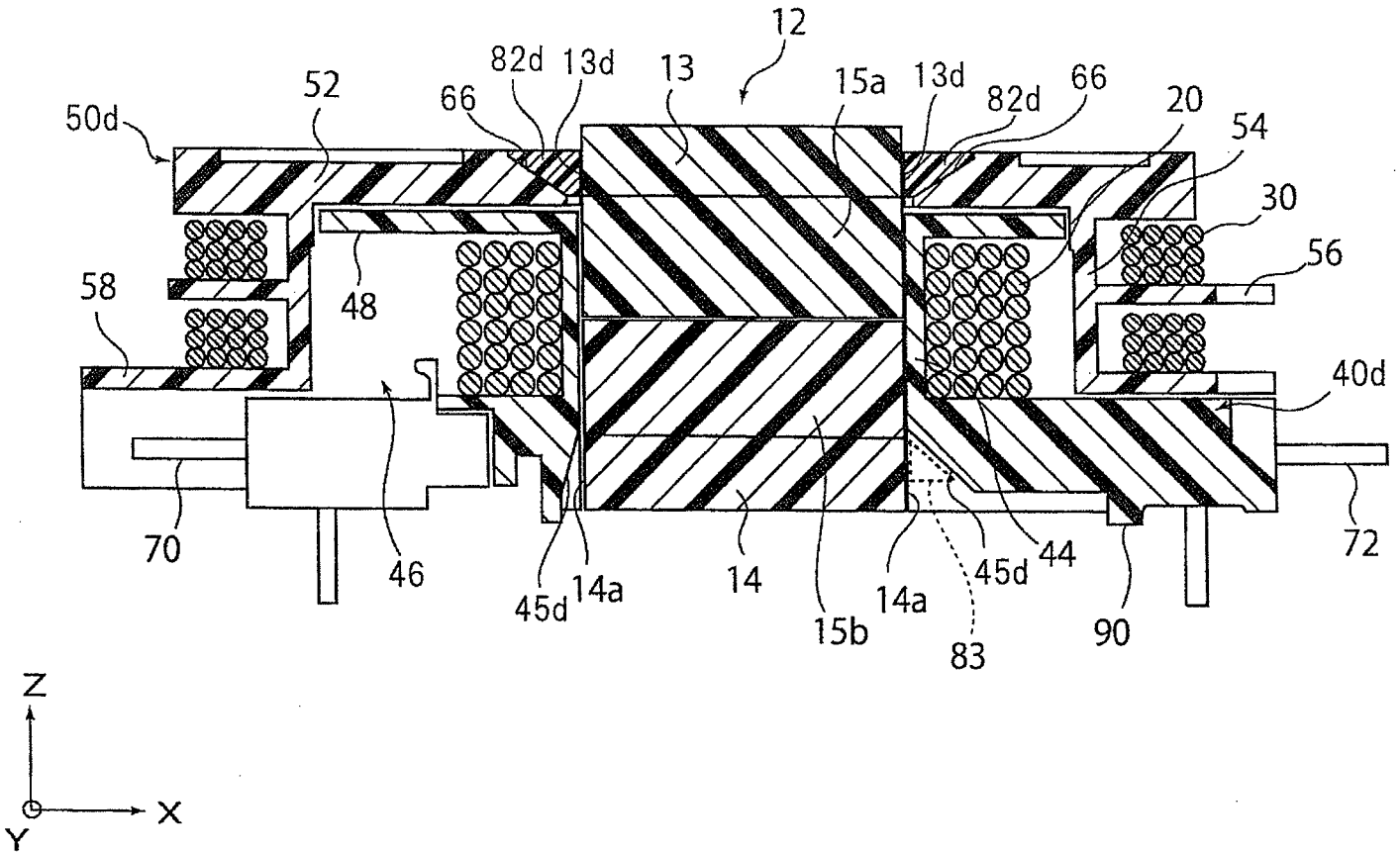
FIG. 8 is a cross-sectional view of transformer shown in FIG. 5, which is perpendicular to the mounting surface.

As shown in FIGS. 6 and 8, the first bobbin 50*d* determines a part of an outer shape of transformer 10*d*, along with holding the first coil 30 (see FIG. 4 and so on). As shown in FIGS. 6 and 8, the first bobbin 50*d* comprises the first hollow cylinder 54, to which the first coil 30 is wound around. The first hollow cylinder 54 function as a bobbin body of the first coil 30.

The first core on-board surface 53*d*, extending approximately parallel to mounting surface 90, is formed on the upper surface of upper collar part 52. The first core on-board surface 53*d* is connected to an end portion (an upper end portion of the first hollow cylinder 54) of the first hollow cylinder 54 closer to the first connection part 13. The first core on-board surface 53*d* is opposed to the first connection part 13 of core 12; and the first connection part 13 of core 12 is mounted to the first core on-board surface 53*d* in an assembly-state of transformer 10*d*.

Figure 7:
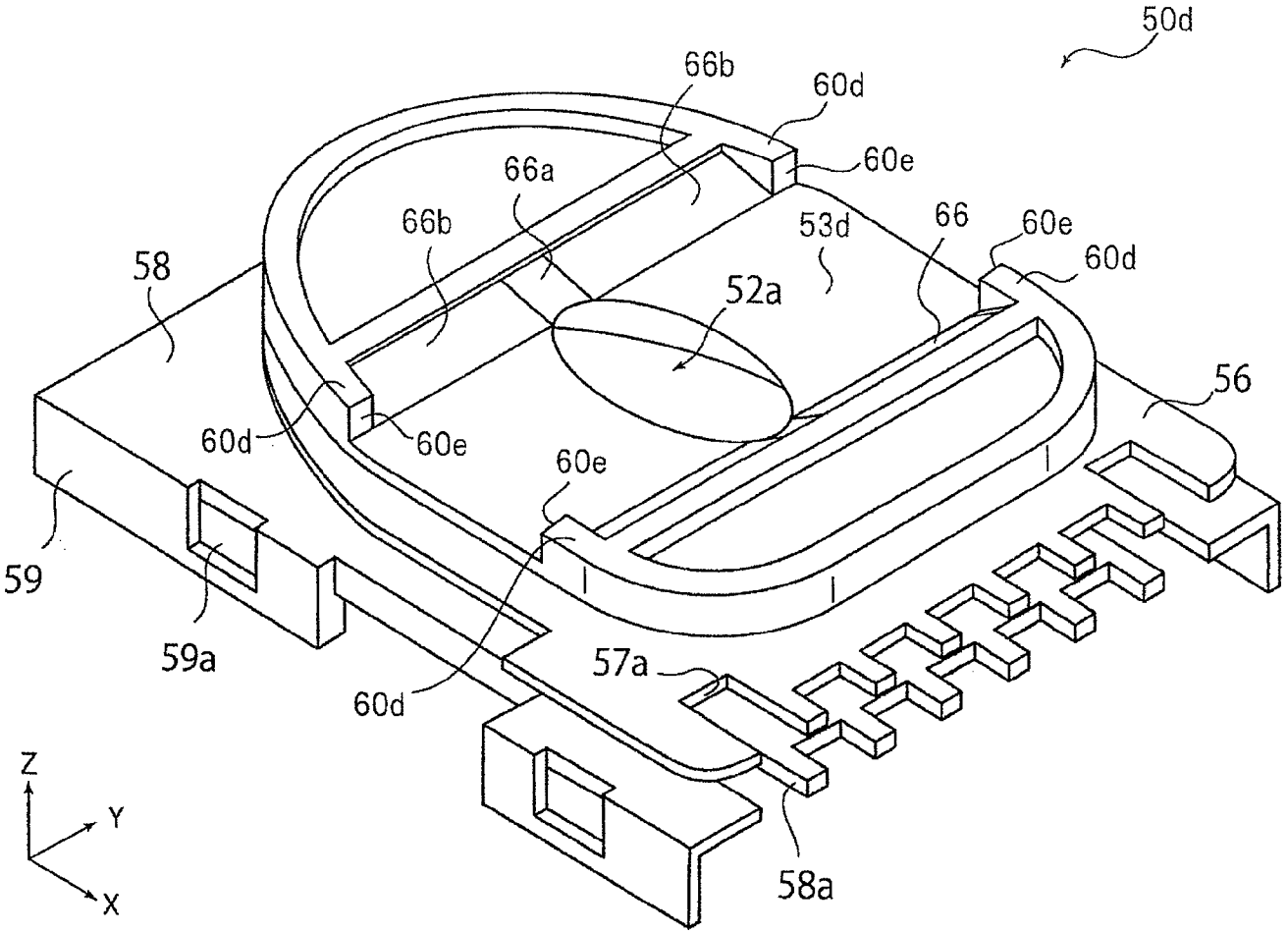
FIG. 7 is a perspective view of the first bobbin included in the transformer shown in FIG. 5.

As shown in FIG. 7, the first inclined surfaces 66 are formed on both sides of the first core on board surface 53*d* of the first bobbin 50*d* in X-axis direction. As shown in FIG. 5, the first inclined surfaces 66 are located on both sides of assembled transformer 10*d* in X-axis direction (a direction parallel to mounting surface 90 and intersecting Y-axis direction) having the first connection part 13 of core 12 in between. As shown in FIGS. 5 and 7, the first inclined surface 66 is an inclined surface rising upward (positive direction of Z-axis) from the first core on-board surface 53*d*.

As shown in FIG. 7, the first inclined surface 66 according to the present embodiment comprises central part 66*a*, located close to through hole 52*a* installing middle leg 15, and side parts 66*b*, sandwiching both sides of central part 66*a* in Y-axial direction. Side part 66*b* is configured with a surface extending in a direction intersecting the first core on-board surface 53*d*; and the central part 66*a* is configured with a curved surface intersecting the first core on-board surface 53*d* and curving along Y-axis direction. Note that a surface configuring the first inclined surface 66 can be any surface if it inclines upward from the first core on-board surface 53*d*. Further, the first inclined surface 66 can be configured with a combination of more than one plane surfaces and curved surfaces.

The first inclined surface 66 function as an adhesion face of adhesion fixing toward the first bobbin 50*d* of core 12. As shown in FIG. 8, the first adhesive hardened part 82*d* is formed between the first connection part side face 13*d* and the first inclined surface 66 of core 12. The first adhesive hardened part 82*d* connect the first inclined surface 66 of the first bobbin 50*d* and the first connection part side face 13*d* of core 12, fixing core 12 to the first bobbin 50*d*. Note that the first connection part side face 13*d* is a face extending in a direction intersecting the first core on-board surface 53*d*; and in the present embodiment, the first connection part side face 13*d* extends approximately parallel to the first core on-board surface 53*d*.

Further, as shown in FIG. 7, positioning part 60*d* is located on both sides of the first core on-board surface 53*d* of the first bobbin 50*d* in X-axis direction, positioning the first connection part 13 of core 12, in addition to the first inclined surface 66. Positioning part 60*d* project from the first core on-board surface 53*d* in Z-axis direction (the first direction). As shown in FIG. 5, positioning parts 60*d* are formed at both sides of the first connection part 13, intersecting the first connection part 13 in a direction parallel to mounting surface 90 and along X-axis direction intersecting Y-axis direction.

Positioning part 60*d* contact the first connection part 13 or comprise positioning surface 60*e*, which is closest to the first connection part 13 among positioning part 60*d*. As shown in FIG. 5, positioning surface 60*e* rise approximately upright from the first core on-board surface 53*d*, and can locate the first connection part side face 13*d* of X-axis direction (a direction perpendicular to Y-axis) opposing to the first connection part side face 13*d*, which is a side face of the first connection part 13.

It is preferable that a plural number of positioning surface 60*e* is located approximately parallel to Y-axis direction (the second direction) at predetermined intervals. In the present embodiment, it is placed in 2 places at both end positions of the first core on-board surface 53*d* in Y-axis direction; namely 4 places in total. The above-mentioned the first inclined surface 66 is sandwiched between positioning surfaces 60*e*, located at both ends. The first inclined surface 66 is formed to connect positioning parts 60*d* located on both sides, and also have a role to improve the strength of upper collar part 52 and the first bobbin 50*d*.

The first adhesive hardened part 82*d* is formed in an area surrounded by positioning part 60*d*, the first inclined surface 66 and the first connection part side face 13*d* (an area shown by dotted line of arrow A) shown in FIG. 5. As shown in the sectional view of FIG. 8, the first adhesive hardened part 82*d* is a hardened adhesion adhering to the first connection part 13 of core 12 and the first bobbin 50*d*, and connect the first connection part side face 13*d* and the first inclined surface 66. The first adhesive hardened part 82*d* extends along the first inclined surface 66 and the first connection part side face 13*d* in Y-axis direction; and the first adhesive hardened part 82*d* connect the first connection part side face 13*d* and the first inclined surface 66. This can be seen not only in the sectional view (See FIG. 8) passing through middle leg 15 (15*a*, 15*b*) but also in the sectional view (See FIG. 9(*a*) passing between middle leg 15 and side legs 16, 18. Note that adhesive hardened part 82*d* is not shown in FIG. 5 in order to show shapes of inclined surface 66 of the first bobbin 50*d* and the like.

As shown in FIGS. 5 and 8, one or more middle collar part 56 which divisionally dispose the first coil 30 in Z-axis direction is set on the outer periphery face of the first hollow cylinder 54, which is located between upper collar part 52 and lower collar part 58, depending on the intended use and etc. of transformer 10*d*. These collar parts 52, 56, 58 are parallel to X-Y plane. The first bobbin 50*d*, comprising these collar parts 52, 56, 58 and the first hollow cylinder 54, is integrally molded by injection molding and the like. As shown in FIG. 8, the first coil 30 is wound around the first hollow cylinder 54; and transformer 10*d* comprises a doubly-structure wherein the second coil 20 and the first coil 30 is wound around middle leg 15 of core 12 twice.

Manufacturing method of transformer 10*d* comprises a method of coating adhesion between the first connection part side face 13*d* and the first inclined surface 66: a place shown by arrow A in FIG. 5, and the first adhesive hardened part 82*d* shown in FIG. 8 is formed, fixing core 12 to the first bobbin 50*d*. Although adhesion forming the first adhesive hardened part 82*d* is not limited, it is preferable to use a relatively high-viscosity adhesion, such as a silicon series adhesion, in terms of connecting the first connection side face 13*d* and the first inclined surface 66, which extend in directions intersecting one another. Further, a gap between connection side face 13*d* and the first inclined surface 66 are designed to have a width, which a nozzle discharging adhesion can suitably approach the coated face.

Further, in addition to adhering core 12 and the first bobbin 50*d*, core 12 and the second bobbin 40*d* may be adhered. As shown in FIG. 8, at a part of downward surface of bobbin substrate 42, the second inclined surfaces 45*d* rising upward toward negative direction of Z-axis from the second core on-board face 45 (see FIG. 6) are formed on both sides of core 12 along X-axis direction sandwiching the second connection part 14 of core 12. Therefore, adhesion can be coated between the second connection part side face 14*a*, a side face of the second connection part 14, and the second inclined surface 45*d*; and the second adhesive hardened part 83, connecting the second connection part side face 14*a* and the second inclined surface 45*d*, can be formed. Note that the second connection part side face 14*a* is a surface of the second connection part 14 extending in a direction intersecting the second core on-board face 45. In the present embodiment, the second connection part side face 14*a* extends approximately perpendicular to the second core on-board face 45.

Transformer 10*d* according to the present embodiment has the same effect with transformer 10*d* according to the first embodiment. Therefore, with the arrangement of core 12 shown in FIG. 5, transformer 10*d* can suppress the occurrence of eddy current in surrounding parts and the like, without placing aluminum shield. Further, by suppressing the occurrence of eddy current, transformer 10*d* can decrease the occurrence of heat and noise associated with the occurrence of eddy current. Further, transformer 10*d* is not necessary to place shield board to shield flux leakage and that a preferable heat dissipation characteristic can be obtained. Furthermore, due to short length of middle leg 15 and side legs 16, 18 of core 12, damage of core 12 by external impact and the like is possible to be prevented.

Here, vertical transformer according to conventional technique had a problem that a sound occurs when driving. Transformer 10*d* according to the present embodiment suppressed sound when driving by improving the fixed structure of core 12 and the first bobbin 50*d*. Namely, as shown in FIG. 8, transformer 10*d* comprises the first adhesive hardened part 82*d* connecting the connection side face 13*d* and the first inclined surface 66 of the first bobbin 50*d*. The first adhesive hardened part 82*d* shown in FIG. 8 is highly-durable against vibration which occur at transformer 10*d*. Therefore, it is possible to firmly fix core 12 to the first bobbin 50*d*, preventing sounds of transformer 10*d*.

Further, removal of adhesion and damages such as crack and the like are hard to occur in the first bobbin 50*d* with the fixed structure of the first adhesive hardened part 82*d* in transformer 10*d*, when compared to a fixed structure connecting opposing faces of core 12 and the first bobbin 50*d*; and that it is preferably used even with the first bobbin 50*d* with relatively low strength.

Figure 9:
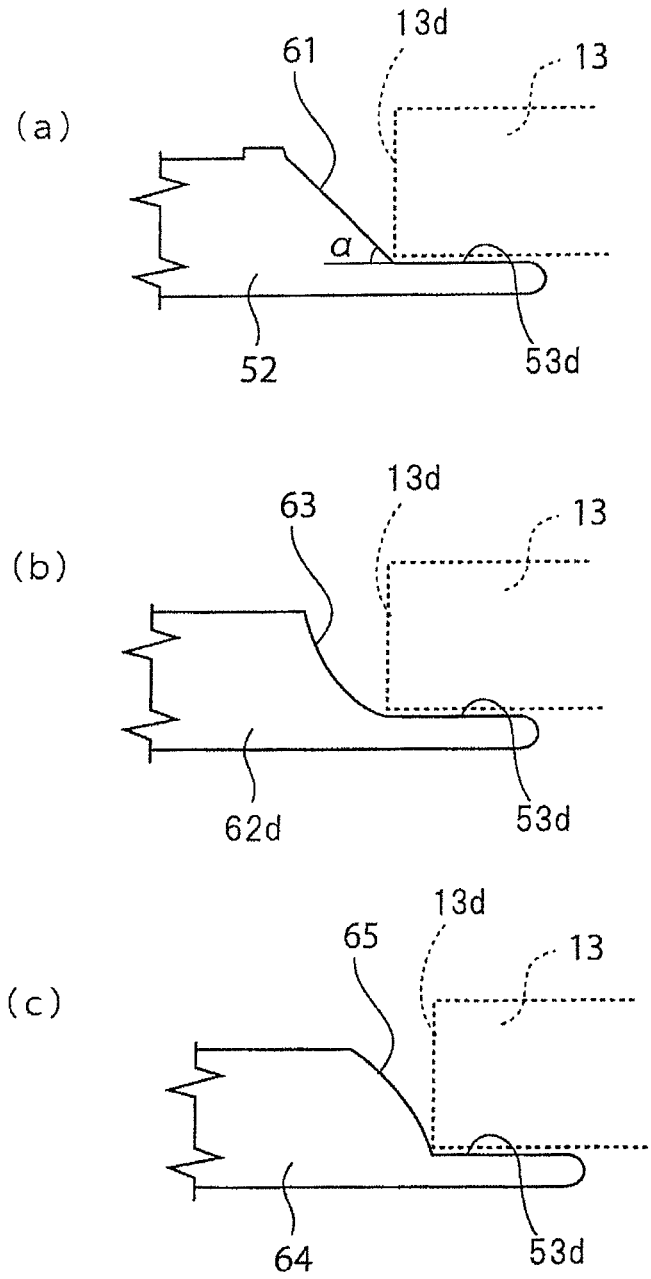
FIG. 9 is an enlarged sectional view around the first inclined surface of the first bobbin and its modifications.
Figure 10:
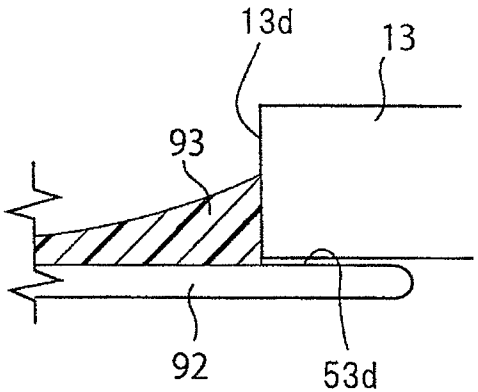
FIG. 10 is an enlarged sectional view around adhesive hardened part of the first bobbin according to reference examples.

Further, the first inclined surface 66 show effects to induce adhesion, injected when assembly, toward a desired adhering surface and to decrease an amount of adhesion required for the adhering. FIG. 10 is an enlarged sectional view of upper collar part 92 within the first bobbin according to reference examples. With the reference example, the first inclined surface is not formed on both sides of the first core on-board surface 53*d*, and that adhesive hardened part 93 broaden along the first core on-board surface 53*d*. This makes it difficult to induce adhesion toward the first connection part side face 13*d*, which is an adhesion surface of core 12. While, transformer 10*d* according to the present embodiment, as shown in FIG. 9(*a*), the first inclined surfaces 66 are formed on both sides of the first core on-board surface 53*d* and that adhesion injected between the first connection part side face 13*d* and the first inclined surface 66 is preferably induced toward the first connection part side face 13*d*. Therefore, the first adhesive hardened part 82*d* (See FIG. 8), connecting the first connection part side face 13*d* and the first inclined surface 66, is possible to firmly and securely connect the first inclined surface 66 and the first connection part side face 13*d*.

Further, transformer 10*d* according to the present embodiment can preferably induce adhesion toward adhesion surface. Accordingly, usage fee of adhesion can be suppressed when compared to the reference example shown in FIG. 10. Inclining angle "α" (See FIG. 9(*a*)) of the first inclined surface 66 with respect to the first core on-board surface 53*d* is not particularly limited; however, such as 15 to 60 degrees are preferable in terms of suppressing an amount of adhesion while reserving reliability of the adhesion between the first inclined surface 66 and the first connection part side face 13*d*.

As shown in FIGS. 5 and 7, within transformer 10*d* according to the present embodiment, positioning surfaces 60*e* locating the first connection part side face 13*d* are formed on both sides of the first core on-board surface 53*d*; and that the first core 12*a* can be easily located relative to the first bobbin 50*d* when assembling. Note that a length of positioning surface 60*e* in Y-axis direction is shorter than a total length of the first core on-board surface 53*d* in Y-axis direction, in order to reserve an area for forming the first inclined surface 66 and the first adhesive hardened part 82*d*. Further, when a plural number of positioning surfaces 60*e* are located along Y-axis direction, a total length of positioning surfaces 60*e* located along Y-axis direction is shorter than that of the first core on-board surface 53*d* along Y-axis direction.

As shown in FIG. 5, it is preferable to locate positioning surfaces 60*e* on both ends of the first core on-board surface 53*d* in Y-axis direction, having the first inclined surface 66 in between, in terms of improving positioning accuracy of core 12. Further, with this arrangement, it is possible to lengthen the first adhesive hardened part 82*d* along second direction, which makes it possible to improve adhesion strength of core 12 and the first bobbin 50*d*.

Further, the first bobbin 50*d* comprising the first inclined surface 66 connected to core 12 by the first adhesive hardened part 82*d* is preferably used for upper bobbin of transformer 10*d* comprising a plural number of bobbins. Within transformer 10*d*, due to a superior fixed structure of the first bobbin 50*d* and core 12, materials of relatively low strength such as PET can be used for the first bobbin 50*d*, and that a structure which simplifies assembly such as a set-in structure using elastic deformation of side surface part 59 can be adapted. Note that, unlike the second bobbin 40*d* where terminals 70, 72 are formed, heat resistance required for solder treatment and the like is not required for the first bobbin 50*d*; and that, in this respect, there are many choices for its material.

The Other Embodiments

As shown in FIGS. 1 to 10, although transformers with a plural number of bobbins, such as the first bobbins 50, 50*d* and the second bobbins 40, 40*d*, are exemplified in the embodiments above, a transformer with a bobbin where the first and the second coils 20, 30 is wound around can also be used in the present invention. Further, the present invention can be applied not only to a doubly-structured transformer 10, 10*d*, where one coil is located at inner circumference side of the other coil, but to one-layer structured transformer, where 2 coils are arranged along Z-axis direction. An effect to suppress sounds and the like can be seen with the one-layer structured transformer, as is the same with the above-mentioned transformer 10, 10*d*. Further, although the first and the second connection parts 13, 14 of core and opposing the first and the second core on-board surface 53, 53*d*, 45 can contact each other, a gap may be formed in between considering their relation of intersecting and the like.

Further, examples of formations of the first inclined surface 66 and the second inclined surface 45*d* formed to the first bobbin 50, 50*d* and the second bobbin 40, 40*d* are not only shown in FIGS. 7 and 9(*a*), but various modification examples can be considered. The first inclined surface may have XZ-sectional plane of concaved curved surface such as the first inclined surface 63 of upper collar part 62*d* shown in FIG. 9(*b*) or XZ-sectional plane of convex curved surface such as the first inclined surface 65 of upper collar part 64 shown in FIG. 9(*c*).

Note that in the present embodiment mentioned above, although sectional view of middle leg 15 (15*a*, 15*b*) of core 12 take the form of ellipse, sectional view of middle leg 15 is not particularly limited and may be a circle, polygonal shape and the like, or may be the other forms. Formation of core 12 is not limited to the formation comprising two side legs 16, 18 sandwiching middle leg 15 in between, and can be a form with only one side leg. Further, wire shapes of the second coil 20 and the first coil 30 are not particularly limited; and they can be a circle, polygonal shape and the like, or the other forms.

Further, the name "the first" and "the second" of coil and terminals are used for convenience; and "the first" is not required to be located at input side and it may be located at output side.

The invention claimed is:

1. A vertical transformer comprising a core provided with a middle leg extending approximately parallel to a first direction perpendicular to a mounting surface and installing a first and a second coils, a side leg extending approximately parallel to the first direction, a first connection part extending approximately parallel to a second direction and connecting an end portion of the middle leg and an end portion of the side leg, where the second direction is parallel to the mounting surface and connecting the middle leg and the side leg, and a second connection part extending approximately parallel to the second direction and connecting the other end portion of the middle leg and the other end portion of the side leg, which is closer to the mounting surface than the first connection part, a first bobbin provided with a first hollow cylinder where at least either the first or the second coil is wound, and a core on-board face connected to an end of the first hollow cylinder at a side closer to the first connection part and extended approximately parallel to the mounting surface, where the first connection part is on-board, and an adhesive hardened part connecting a connection side face and the core on-board face, where the connection side face is a face of the first connection part extended in order to intersect with the core on-board face, and formed by hardening an adhesion, wherein the core on-board face is provided with a positioning projection formed on both sides of the first connection part having the first connection part in between in the direction parallel to the mounting surface and intersecting the second direction, where the positioning projection is provided with a positioning part positioning the connection side face and projects from the core on-board face toward the first direction.

2. The transformer as set forth in claim 1, wherein a plural number of the positioning part is located approximately parallel to the second direction at predetermined intervals, and the adhesive hardened part is formed between a plural number of the positioning part.

3. The transformer as set forth in claim 2, wherein the positioning part is located on both ends of the core on-board face along the second direction.

4. The coil device as set forth in claim 1, wherein a wall section, extending approximately parallel to the second direction and is located by having the adhesive hardened part between the first connection part and said wall section, is formed.

5. The coil device as set forth in claim 1, further comprising a second bobbin provided with a second hollow cylinder which either the first or the second coil is wound, and a terminal mounting part connected to an end of the second hollow cylinder at a side close to the mounting surface, where a terminal electrically connected to the first and the second coils is mounted, wherein the other the first or the second coil is wound to the first bobbin.

6. The transformer as set forth in claim 1, wherein either the first or the second coil locate at inner circumference side of the other the first or the second coil.

7. A vertical transformer comprising a core provided with a middle leg extending approximately parallel to a first direction perpendicular to a mounting surface and installing a first and a second coils, a side leg extending approximately parallel to the first direction, a first connection part extending approximately parallel to a second direction, a direction parallel to the mounting surface connecting the middle leg and the side leg, and connecting an end portion of the middle leg and an end portion of the side leg, and a second connection part extending approximately parallel to the second direction and connecting the other end portion of the middle leg and the other end portion of the side leg, a first bobbin provided with a first hollow cylinder where at least either the first or the second coil is wound, a first core on-board face connected to an end of the first hollow cylinder at a side closer to the first connection part, extended approximately parallel to the mounting surface, and opposed to the first connection part, and a first inclined surface formed on both sides of the first connection part having the first connection part in between in the direction parallel to the mounting surface and intersecting the second direction, rising from the first core on-board face to the first direction, and a first adhesive hardened part, connecting a first connection side face and the first inclined surface of the first bobbin, where the first connection side face is a face of the first connection part extended in order to intersect with the first core on-board face, and formed by hardening an adhesion.

8. The vertical transformer as set forth in claim 7, wherein the first bobbin comprises a positioning surface located on both sides of the first connection part having the first connection part in between in the direction parallel to the mounting surface and intersecting the second direction, rising approximately upright from the first core on-board face.

9. The vertical transformer as set forth in claim 8, wherein the positioning surface is located on both ends of the first core on-board face along the second direction having the first inclined surface in between.

10. The vertical transformer as set forth in claim 7, wherein the first inclined surface is inclined at 15 to 60 degrees to the first core on-board face.

11. The vertical transformer as set forth in claim 7, further comprises the second bobbin provided with a second hollow cylinder where either the first or the second coil is wound, and a second core on-board face connected to an end of the second hollow cylinder at a side closer to the second connection part, extended approximately parallel to the mounting surface, and opposed to the second connection part, wherein the other the first or the second coil is wound to the first bobbin.

12. The vertical transformer as set forth in claim 11, wherein the second bobbin is provided with a second inclined surface formed on both sides of the second connection part having the second connection part in between in the direction parallel to the mounting surface and intersecting the second direction, rising from the second core on-board face to a opposing direction of the first direction, and a second adhesive hardened part is formed between a second connection side face and the second inclined surface of the second bobbin, which connect the second connection part side face and the second inclined surface and is formed by hardening an adhesion, where the second connection side face is a face of the second connection part extended in order to intersect with the second core on-board face.

13. The vertical transformer as set forth in claim 7, wherein the first or the second coil is located at inner circumference side of the other the first or the second coil.

* * * * *